United States Patent [19]

Hunter

[11] 4,083,774

[45] Apr. 11, 1978

[54] MAGNETIC SEGREGATION OF MIXED NON-FERROUS SOLID MATERIALS IN REFUSE

[75] Inventor: Jack A. Hunter, Long Grove, Ill.

[73] Assignee: UOP Inc., Des Plaines, Ill.

[21] Appl. No.: 655,037

[22] Filed: Feb. 3, 1976

[51] Int. Cl.[2] ..... B03C 1/22

[52] U.S. Cl. ..... 209/212; 209/223 R

[58] Field of Search ..... 209/212–214, 209/227, 223 R, 231

[56] References Cited

U.S. PATENT DOCUMENTS

| | | | |
|---|---|---|---|
| 3,448,857 | 6/1969 | Benson | 209/212 |
| 3,824,516 | 7/1974 | Benowitz | 209/212 X |
| 3,950,661 | 4/1976 | Langmuir | 209/227 X |

FOREIGN PATENT DOCUMENTS

| | | | |
|---|---|---|---|
| 26,590 | 2/1931 | Australia | 209/212 |
| 174,875 | 10/1951 | Austria | 209/223 R |
| 2,059,166 | 6/1972 | Germany | 209/223 R |
| 2,509,638 | 9/1975 | Germany | 209/212 |

*Primary Examiner*—Robert Halper

*Attorney, Agent, or Firm*—James R. Hoatson, Jr.; Philip T. Liggett; William H. Page, II

[57] ABSTRACT

After an initial separation of paper, plastics and the light fibrous types of materials, as well as magnetically removable ferrous metals, from refuse material, the remaining mixed solid materials are projected outwardly in a generally horizontal path and subjected to a "flight-path" type of segregation where a magnetic field is used to influence and lessen the length of the trajectory of the conductive metals in the mixture of materials. The magnetic field induces a retarding force related to the size, conductivity and to some extent to the shape of the fragments which, in combination with the force of gravity, modifies the trajectory of different materials. As a result, fragments of different types of materials will tend to "drop out" at different distances along the general flight path according to their individual electrical conductivity properties. Segregation of the initially mixed materials will be accomplished by having successively positioned collection zones under and along the flight path where the low density-high conductivity materials fall into the closer zones and the high density-low conductivity materials will carry to the further zones.

3 Claims, 1 Drawing Figure

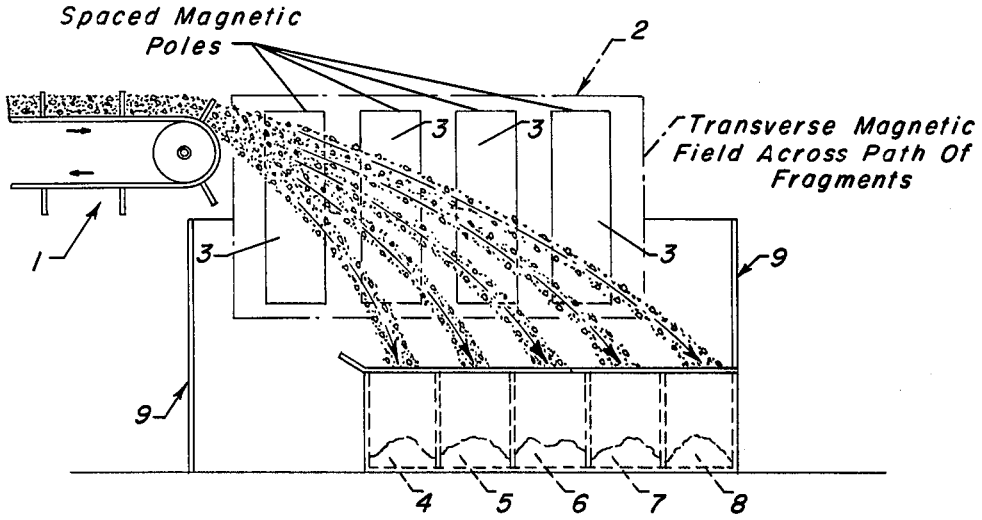
Spaced Magnetic Poles
2
3
3
Transverse Magnetic Field Across Path Of Fragments
1
3
3
9
9
4
5
6
7
8

MAGNETIC SEGREGATION OF MIXED NON-FERROUS SOLID MATERIALS IN REFUSE

The present invention relates to a method for effecting the segregation of mixed, non-ferrous, solid material fragments in refuse or waste by the use of a combination of gravity and the retarding force of a magnetic field acting on such material that may be at least partially electrically conductive.

More particularly, the present invention is directed to a flight-path type of separation where a magnetic field is used to influence the length of the trajectories of mixed fragments of non-ferrous solids materials, with each conductive fragment generating eddy-currents and individual magnetic fields causing drag forces proportional to its conductivity such that different types of materials will have differing descent trajectories into successively positioned collection zones responsive to varying drag forces and varying densities.

Inasmuch as the present method of operation combines gravity and magnetic retarding forces to obtain a resultant effect, it is to be noted that the descent rate or length of trajectory for each fragment in the mixture of metals, or of mixed solids, will be related to the conductivity and density of the particular fragment. For example, where fragmented pieces of material are to be projected laterally through a defined zone with a magnetic field provided across (perpendicular to) the path of movement, then the non-conducting, high density material, such as glass and stone will be the least affected and will carry the greater distances as compared to conductive particles. As a result, and by way of further example, a lightweight metal that has fairly good conductivity, such as aluminum fragments, would have the least trajectory and copper, zinc, lead, etc., would carry farther to be collected in the successive intermediate zones.

In the handling and reclamation of solid waste, it is, of course, understood that the use of magnetic separations in an old and well-known procedure, particularly for removing and collecting the ferrous metals from refuse. In addition, magnetic eddy-current separations have been used to some degree to effect a separation of aluminum from refuse material; however, the use of magnetic forces in the present manner for segregating various metals, and non-metal materials from a mixture of non-ferrous metals is not believed to be in usage in any known processing operations, at least with respect to refuse handling plants. It is also realized that many types of magnetic separation and concentration procedures have been developed and are in use in connection with the handling of ores, ore tailings, etc. However, again it is to be noted that these types of operations are primarily involving the separation of ferrous materials and magnetically susceptible materials.

In the present instance, it may be considered a principal object of the invention to provide for the segregation of mixed non-magnetic materials by generating drag forces to influence lateral velocity and hence position of fall of the various electrically conductive fragments in a mixture of solids materials being handled in a refuse reclamation system.

It may also be considered an object of the present invention to provide a system which can operate continuously to segregate mixed non-magnetic materials, with the continuous system using individual eddy-currents and counter-magnetic forces to influence the distance of travel for fragments that project at a constant velocity into a magnetic field having its lines of force perpendicular to the initial, generally horizontal projection of such fragments.

Broadly, the present invention provides a method for effecting the segregation of mixed solids materials, including mixed, non-magnetic metals obtained in the processing of collected refuse after prior removals of low density materials such as paper, cloth and plastic and magnetically removable ferrous materials, which comprises the steps of: (a) projecting the mixed solid materials in fragmented form at a constant velocity and substantially horizontally outwardly above a plurality of successively positioned material collection zones, (b) providing a magnetic field across the succession of collection zones and perpendicular to the pathways of the projected materials to cause material fragments to cut through the magnetic force lines, thereby inducing eddy-currents in the various fragments of conductive materials and resulting individual magnetic fields therewith to cause drag forces on such fragments proportional to their individual conductivities, and (c) collecting the solids materials in said successively positioned collection zones in a resulting segregated manner, where gravity and the drag forces will cause highly conductive fragments to fall into the closer zones and permit low conductivity fragments to carry to the farther zones.

Various types of means may be provided for projecting the solid materials across the magnetic field and above the collection zone; however, generally a suitable conveyor belt means may be utilized to effect the projection of the fragmented material at a constant velocity through the magnetic field. As heretofore indicated, there can be the magnetic removal of ferrous materials and the shreading and fragmentation of all of the refuse material along with air classification to remove paper, plastics, cloth and various fibrous materials from the various metals and other high density solids. As a result, a preferred segregation procedure will have merely the non-ferrous, non-magnetic mixed metals retained on the feed means along with non-conductive glass, stone, etc.

The magnetic field for the present operation will be provided to extend transversely across the field of flight for the mixed solid materials such that all of the fragments will be cutting across the magnetic lines of force provided by the field. The non-conductive materials will be unaffected by the magnetic field while the conductive fragments will generate eddy-currents which, in turn, produce individual magnetic fields for each individual fragment. There will in turn be resulting counter-acting drag forces created for the conductive fragments and the drag forces will be proportional to the conductivity of the particular piece of material. Under the influence of gravity, all of the fragments will be accelerated downwardly and as a result of the different decelerations due to drag forces, the various types of materials will have different trajectories to reach different spaced collection zones. Thus, with collection zones being successively spaced from below the discharge end of the particle projecting conveyor and outwardly therefrom to receive projected fragments, there will be the collection of high density and low conductivity materials at the farthest collection zone(s) while, conversely, a low density and high conductivity material, such as aluminum, would fall into the nearest collection zone. The materials such as copper, zinc, and lead would, for example, carry to the next successive collection zones by reason of the combinations of their conductivity properties and their densities. The magnetic field itself may be formed from utilizing a plurality of spaced apart permanent magnets or from spaced apart electromagnets. The magnetic field is preferably of a non-alternating type since alternating magnetic fields are generally more costly.

A preferred installation will also make use of a wall or screening means around the material collection zone in order to preclude stray air or wind current interference with the material trajectories and the drag force effects on each of the material fragments. Depending on the exact nature of the material mixture being separated, e.g., different sizes, thickness or shape, an air stream flowing in the general direction of the moving fragments with a similar velocity may be employed to minimize the effects of wind resistance with improvement in the effectiveness of separation. The shielding material will be in a positioning and of a material that will not interfere with the main magnetic field, or with the introduced eddy-currents and magnetic fields for each fragment of conductive material, in order that there may be a maximum amount of retarding force to combine with gravity for each falling fragment.

Reference to the accompanying drawing and the following description thereof will serve to illustrate the operation of the present system and its advantageous features in effecting segregation of non-magnetic mixed materials.

Referring now particularly to the diagrammatic drawing, there is indicated a conveyor means 1 which will carry the mixed metals and other non-magnetic solid materials at a constant relatively high velocity in order to provide a generally horizontal initial trajectory for all of the fragments being carried by the conveyor means. In accordance with the present invention, there will be provided a transverse magnetic field within a general trajectory area indicated at 2, which, in turn, will be provided by spaced apart opposing magnetic poles such as at 3 on one side of the flight zone and magnetic poles not shown which would be in opposition thereto on the other side of the particle trajectory zone.

The north poles of the plurality of magnets would be on one side of the area and the south poles in an opposing manner on the other side. A plurality of collection bins, indicated as 4, 5, 6, 7 and 8 are indicated as being at a lower elevation than the conveyor means 1 and the magnetic field 2 in order to provide for segregated collection of the various types of fragments within the mixed solids material charge. Although the individual collection bins or zones are diagrammatically illustrated as being of about the same size, it is to be understood that varying lengths or widths may be utilized for various of the bins in order that there may be a more efficient collection of certain types of materials and in order to take care of varying trajectory distances. Also, depending upon the general nature of the mixed materials being carried to the segregation system, there may be a greater or lesser number of collection bins to accommodate the collection of the various types of materials.

In the actual operation of the present arrangement, there will be the initial constant velocity introduction of all of the solid material from conveyor means 1 across the transverse magnetic field 2 such that the conductive materials will be cutting through the transverse magnetic lines of force to effect the initiation of eddy-currents within each of the conductive fragments that will in turn produce opposing individual magnetic fields and a resulting drag force on each conductive fragment which will act to retard the otherwise normal lateral distance of trajectory travel. Where there is no drag force effect on a non-conductive and high density material, it will carry the greater distance and reach the farthest collection zone 8. Conversely, the less dense, lightweight and highly conductive materials, such as aluminum, will carry the shortest distance and would be collected in the nearest bin such as at 4. The other materials, depending upon density and upon conductivity would be collected in the intermediate collection zones. For example, copper fragments could be collected in the next successive zone 5, zinc in a second successive zone 6, lead containing materials in a third successive zone 7, while the non-conductive materials would carry the farthest and into a zone 8 as heretofore indicated.

It is to be understood that the present drawing is diagrammatic and that various types of material introduction means may be utilized and various types of bins or collection zones provided to effect the reception of resulting segregated materials. The overall efficiency of the system will depend to some degree on providing sufficient trajectory distances and some height differential between the introduction point and the collection level in order that there may be the combination of drag forces and gravity to effect the travel for each particular fragment and in turn bring about a segregation of the various types of materials as related to their conductivity and density characteristics. There is thus obtained a resulting flight path type of separation for the mixed solid materials introduced into the segregation area. For illustrative purposes, there is a wall or wind screen 9 provided to surround the trajectory area and the magnetic field zone in order to preclude stray wind interference with the effect of the magnetic field on the individual fragments. It is to be further understood that the diagrammatic indication of the plurality of spaced magnetic poles is merely pictorial and that various magnetic pole arrangements may be provided to result in a desired form of transverse magnetic field. Also, with respect to induced air flow, it is not deemed necessary to indicate that blower means and air distribution means or, alternatively, air suction means can be made connective with the trajectory zone to effect a general air movement at the average velocity of particle movement to assist in overcoming air resistance. The provision of air blowers or air suction means are generally conventional and well understood so that it is not deemed necessary to illustrate such a provision in the present diagrammatic drawing.

I claim as my invention:

1. A method for effecting the segregation of mixed solids materials, including mixed, non-magnetic metals obtained in the processing of collected refuse after prior removals of low density materials and magnetically removable ferrous materials, which comprises the steps of:

(a) projecting the mixed solid materials in fragmented form from the surface of a moving belt terminating above and at one end of a magnetic field such that said material fragments will be projected at a constant velocity and substantially horizontally outwardly above a plurality of successively positioned material collection zones, (b) providing a series of magnetic fields on each side of and perpendicular to the pathways of the projected materials to cause material fragments to cut through the magnetic force lines, thereby inducing eddy-currents across said collection zones and in the various fragments of conductive materials which provides individual magnetic fields therewith to cause drag forces resisting the horizontal movement of such fragments proportional to their individual conductivities, (c) providing an air flow generally in the direction of the fragment trajectories and with a velocity approximating the average velocity of the fragments to minimize the effect of wind resistance which otherwise might interfere with the separation of the materials, and (d) collecting the solids materials in said successively positioned collection zones in a resulting segregated manner, where the combination of gravity and the drag forces will cause low density and highly conductive fragments to fall into the closer zones and permit high density and low conductivity fragments to carry to the farther zones.

2. The method of claim 1 further characterized in that said magnetic field is provided from a plurality of spaced apart permanent magnets, with opposing poles on each side of the particle trajectory zone to provide magnetic lines of force transversely across such zone.

3. The method of claim 1 further characterized in that said magnetic field is provided from a plurality of spaced apart electromagnets, with opposing poles on each side of the particle trajectory zone to provide magnetic lines of force transversely across such zone.

* * * * *